US005845443A

United States Patent [19]

Wirkus et al.

[11] Patent Number: 5,845,443

[45] Date of Patent: Dec. 8, 1998

[54] GLASS BLOCK FIRE WALL

[76] Inventors: Randolf Andrew Wirkus; Michelle Ann Wirkus, both of 32 Norm Street, Kenmore, Queensland, Australia, 4069

[21] Appl. No.: 788,245

[22] Filed: Jan. 27, 1997

Related U.S. Application Data

[62] Division of Ser. No. 519,206, Aug. 25, 1995, Pat. No. 5,640,819.

[30] Foreign Application Priority Data

Aug. 25, 1994 [AU] Australia ..... PM7676
May 26, 1995 [AU] Australia ..... PM3191

[51] Int. Cl.[6] ..... E04B 1/12
[52] U.S. Cl. ..... 52/308; 52/656.8
[58] Field of Search ..... 52/306, 307, 308, 52/204.61, 456, 656.8

[56] References Cited

U.S. PATENT DOCUMENTS

| | | | |
|---|---|---|---|
| 3,340,661 | 9/1967 | Krieger | 52/204.61 X |
| 3,411,258 | 11/1968 | Kessler | 52/456 |
| 4,644,721 | 2/1987 | Bloomquist et al. | 52/456 |
| 4,970,840 | 11/1990 | Ouellette et al. | 52/456 X |
| 4,986,048 | 1/1991 | McMarlin | 52/306 |
| 5,031,372 | 7/1991 | McCluer | 52/307 |
| 5,174,091 | 12/1992 | Stokx | 52/656.8 X |
| 5,430,985 | 7/1995 | Coleman | 52/308 |
| 5,485,702 | 1/1996 | Sholton | 52/307 X |

*Primary Examiner*—Lanna Mai
*Attorney, Agent, or Firm*—Helfgott & Karas, P.C.

[57] ABSTRACT

A glass block wall 10 shown partially completed and employing a plurality of glass blocks 11 forming the wall. The frame elements 12 are made from milled compressed fibrous cement, are positioned between the blocks and are secured in place at their ends using anchor brackets 13 screwed or otherwise fastened to a wall or frame.

8 Claims, 6 Drawing Sheets

GLASS BLOCK FIRE WALL

This is a division of application Ser. No. 08/519,206, filed Aug. 25, 1995 now U.S. Pat. No. 5,640,819.

BACKGROUND OF THE INVENTION

THIS INVENTION relates to a glass block wall and in particular to a fire resistant separation strip used in the construction of a glass block wall.

SUMMARY OF THE INVENTION

In a preferred form the present invention employs a support assembly utilising channels formed in glass bricks of the type made from two hollow halves welded together and wherein a separation strip or frame element is located between adjacent glass bricks. The separation strip or frame element has opposed longitudinally extending beading locating the separation strip in the channels of said adjacent glass bricks, the separation strip being supported at its end by a bracket telescopically engaging the separation strip.

In one embodiment the bracket employs a plurality of fingers adapted to project into a hollow portion of the separation strip to thereby support the separation strip at a predetermined orientation relative to a main frame member.

In a further embodiment the bracket includes a plurality of fingers adapted to straddle the separation strip thereby projecting into the channels of adjacent glass bricks with fingers projecting into the channels above and below the separation strip. The fingers are typically about the same thickness as the beading so that the fingers locate flush or below the beading in the separation strips. Typically two fingers are positioned on either side of the separation strip, the fingers protruding generally at 90° to the bracket body, the bracket body being generally planar and being adapted to be fastened to a wall, frame or the like.

Preferably, the bracket includes a marker or position indicating means so the bracket can be located at a predetermined position so that the separation strip supported by the bracket is positioned generally at 90° to the wall or support to which the bracket is fitted.

Typically, the separation strip is self locating in a channel of the glass bricks and includes a hollow into which support member fingers project.

In one application the present invention is used in a glass block fire wall comprising a plurality of glass blocks forming a wall, frame elements separating adjacent glass blocks, the frame elements being made from a fire resistant material, typically a compressed fibrous cement with the frame elements being supported by brackets.

Typically horizontal and vertical frame elements are employed in the wall.

The frame elements are preferably elongate prefabricated compressed fibrous cement strips having channels or recesses in opposite faces thereof. The strips are typically medially bulged in shape having relatively narrow edges so that in profile the strips taper toward their edges.

Preferably the strips are secured in position using brackets having fixed end sockets with opposite ends of the strips plugging into respective sockets. The sockets are preferably carried on mounting brackets or plates secured to a support by fasteners. The bracket or plate preferably includes an aperture forming the socket or the socket can be formed as a projecting ring-like member shrouding a marginal end portion of the strip.

The glass block fire wall preferably includes three separate materials applied between the blocks, firstly a fire-proof silicon or equivalent is applied as a bedding in a space between each block and the framing strip and then grouting in the form of a fire rated sealant or equivalent is used between blocks adjacent the respective edges of the framing strips.

The glass block wall is typically built up with a peripheral gap which is later filled with a fire-proof material. Preferably a polyurethane expanding foam or fire-proof ceramic fibre blanket designed to absorb expansion and contraction is compacted into the gap around the glass block wall, then the gap is sealed with fire rated sealant.

In another aspect the present invention resides in a glass block wall frame element supported by a bracket comprising a strip of compressed fibrous cement or functional equivalent, the strip preferably having opposed tapered marginal edge portions and being medially bulged and having opposite faces including channels or recesses extending longitudinally therein and being telescopically retained by the bracket.

In another aspect the invention resides in an anchor bracket for a frame element of a glass block wall, the bracket having a socket adapted to support an end portion of a framing strip against transverse movement. The socket is preferably shaped to correspond with the cross-sectional shape of the framing strip.

BRIEF DESCRIPTION OF THE DRAWINGS

In order that the present invention can be more readily understood and be put into practical effect reference will now be made to the accompanying drawings and wherein.

DESCRIPTION OF THE PREFERRED EMBODIMENTS

Figure 1:
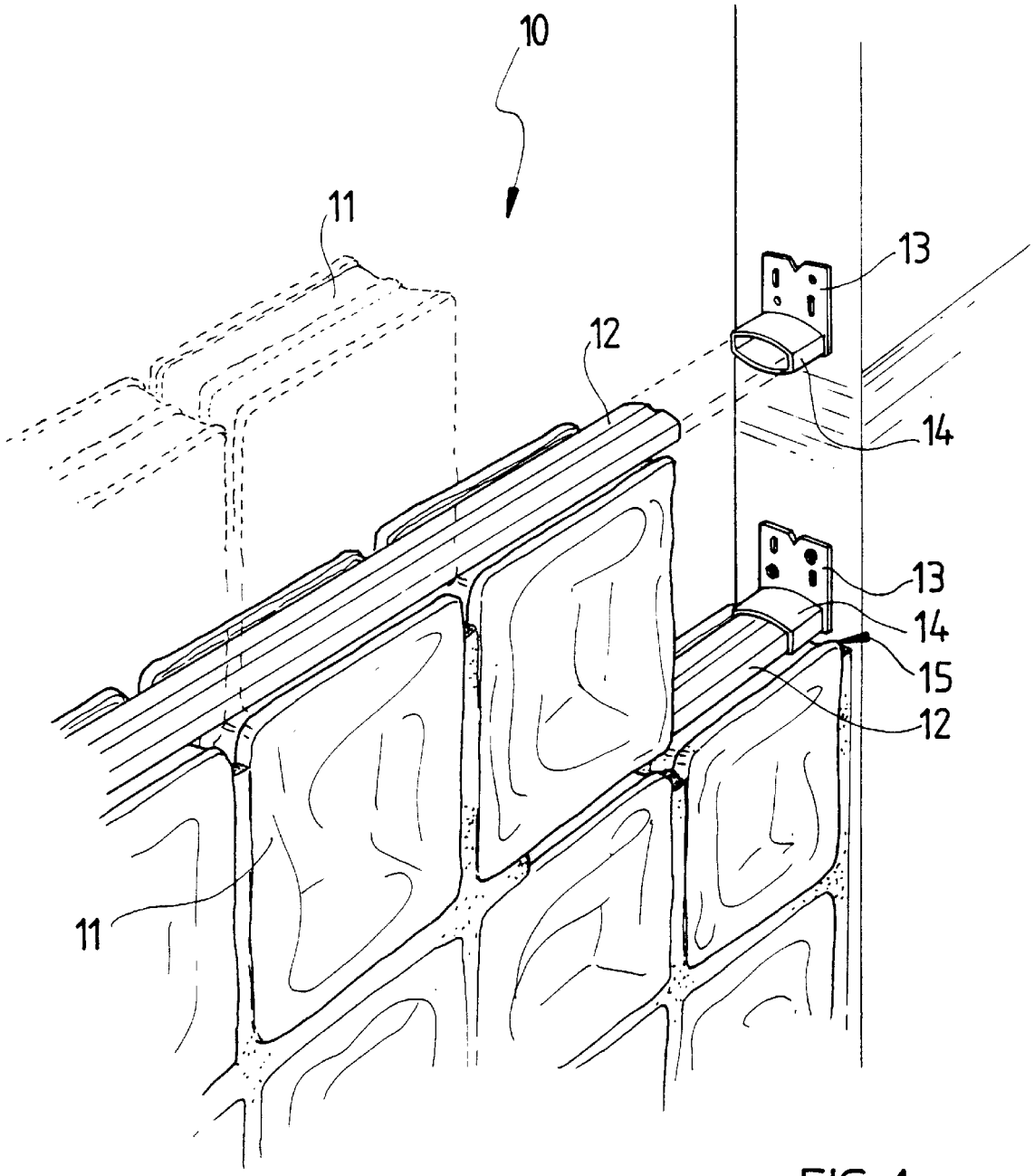
FIG. 1 is a part construction of a glass block wall according to the present invention.

Referring to the drawings and initially to FIG. 1 there is illustrated a glass block wall 10 shown partially completed and employing a plurality of glass blocks 11 forming the wall. The frame elements 12 are made from milled compressed fibrous cement, are positioned between the blocks and are secured in place at their ends using anchor brackets 13 screwed or otherwise fastened to a wall or frame as shown in FIG. 1.

As can be seen in FIG. 1 the brackets 13 include a projecting socket portion 14 and the framing elements 12 fit neatly into the projecting socket portion 14. The projecting socket portion 14 in use creates a gap at 15 between the peripheral glass blocks and the wall and this gap must be filled. Likewise grouting is applied between the glass blocks.

Figure 2:
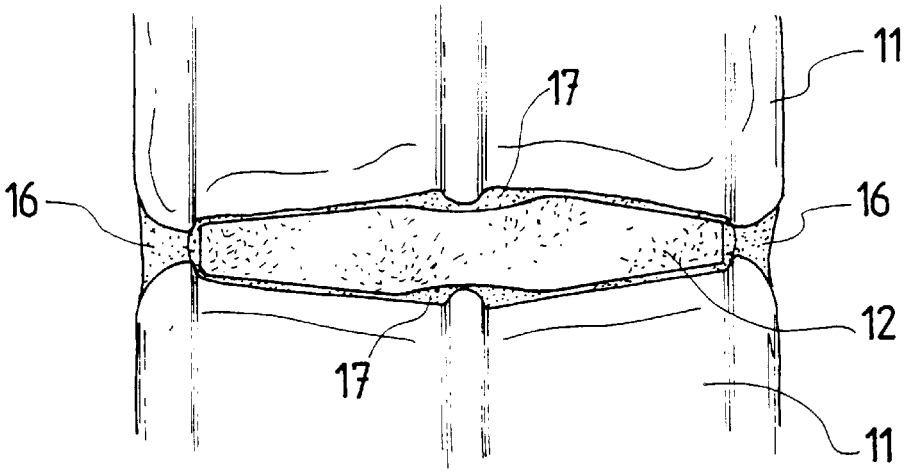
FIGS. 2 to 4 are sections illustrating typical embodiments of the invention.
Figure 3:
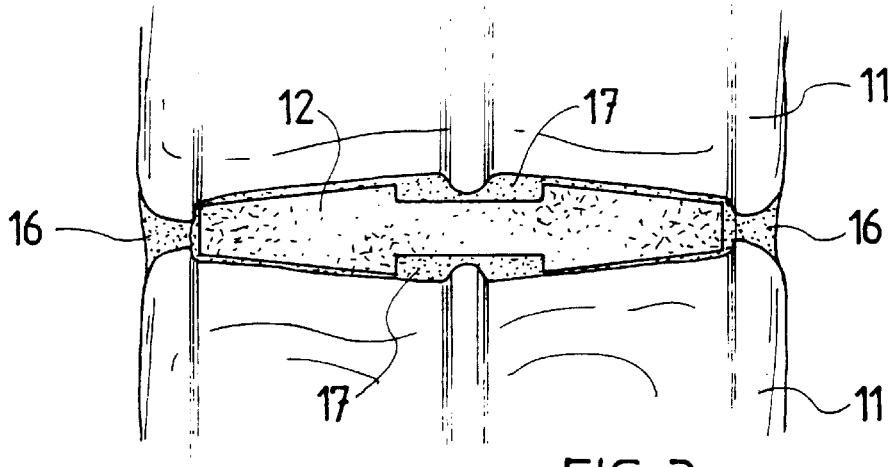
Figure 4:
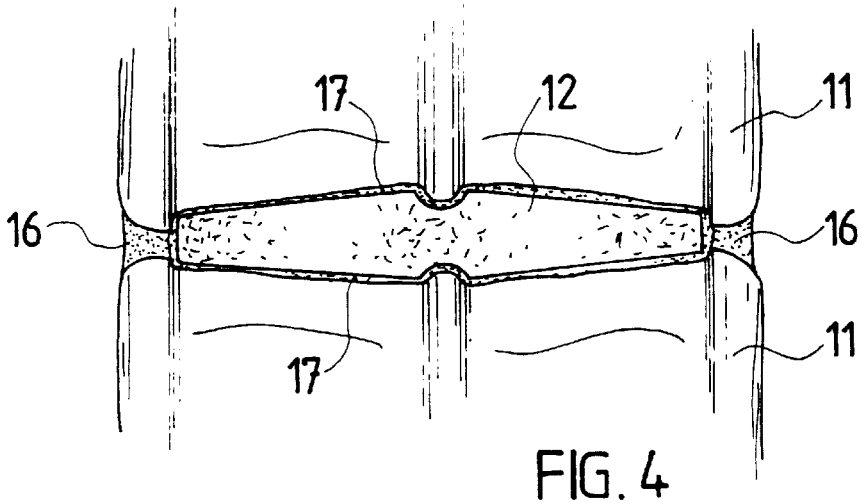

Referring now to FIGS. 2 to 4 there is illustrated in section various different shaped separation strips 12, and as is evident from FIGS. 2, 3 and 4 a layer of silicon is applied at 17 between the glass blocks and the strips. This layer of silicon assists in bonding the strips to the glass blocks and therefore resists cracking of the layer between the glass blocks and the strips should a fire cause expansion of the wall. A fire-retardant sealant is employed as grouting at 16.

The strips illustrated in FIGS. 2 to 4 are made from the common building material fibrous cement and can be formed using commonly used processes including molding or milling to form a solid strip. Fibrous cement products including wall panels are common and are usually made by molding under pressure. The strips of FIGS. 1 to 4 can be made using any of the known common methods. The glass blocks 11 due to their method of construction, common in glass blocks, create a void between runs of glass blocks, this void is filled by the separation strips, the separation strips are solid and free from projections that might chip or break and are matched to the shape of the void to maximize fire retardant qualities and strength of the strips for handling purposes.

Figure 5:
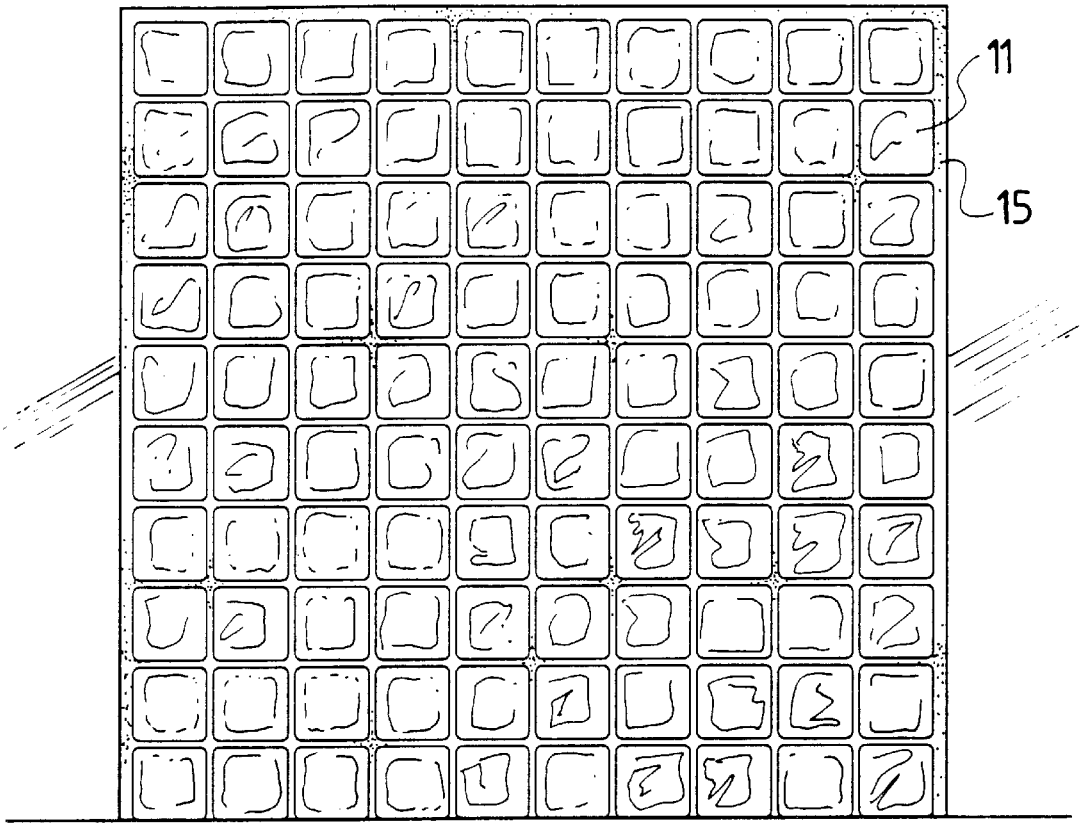
FIG. 5 is a completed glass block wall.

A full glass block fire wall is shown in FIG. 5. As can be seen a peripheral gap is formed at 15 and this is filled. Preferably this is filled according to the description set out above.

Figure 6:
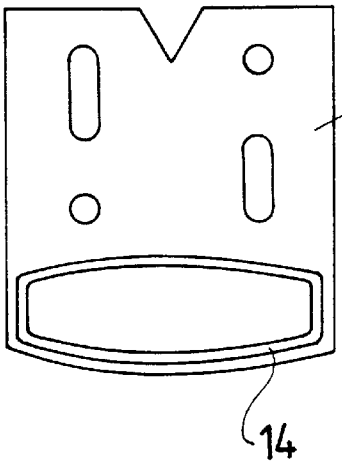
FIG. 6 is a front view of a typical bracket.
Figure 7:
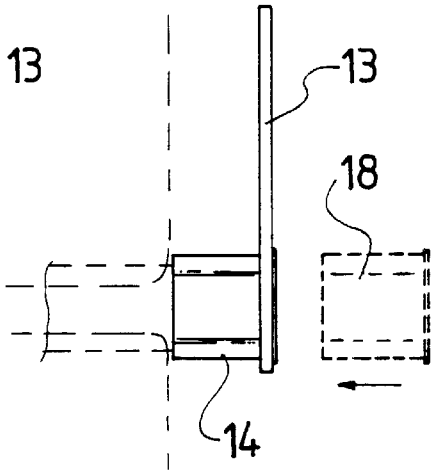
FIG. 7 is a side view of the bracket of FIG. 6 also showing assembly details in phantom.

Referring to FIGS. 6 and 7 an alternative bracket is illustrated and as can be seen the bracket is made up of a plate 13 and a hollow ring section 14 having a peripheral roll 18, the ring section being made separately of the plate so it fits into position shown in FIG. 7.

Figure 8:
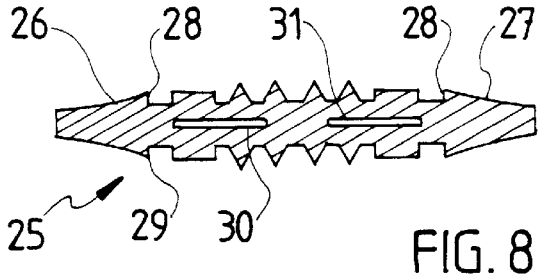
FIGS. 8 to 10 illustrate a further embodiment of the present invention.
Figure 9:
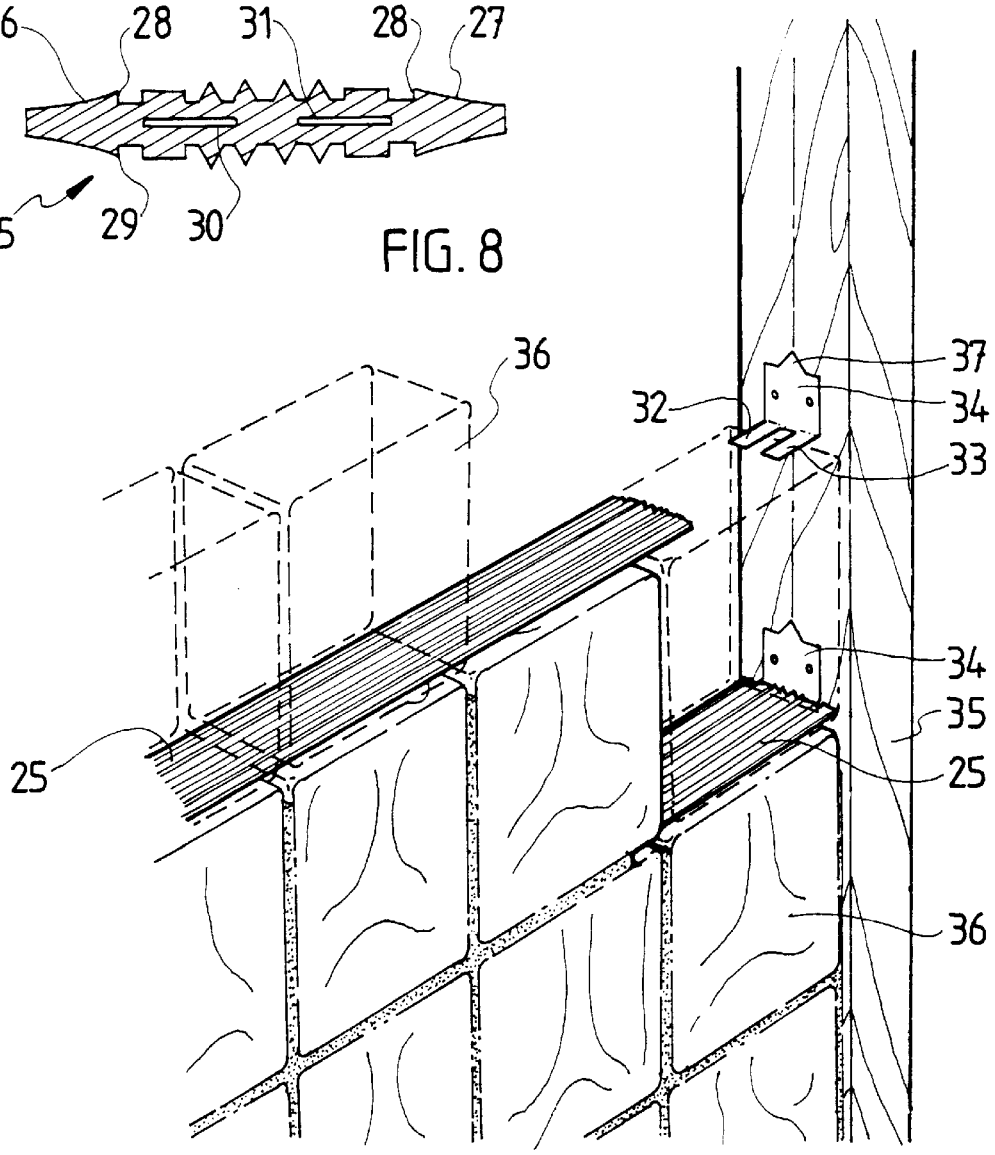
Figure 10:
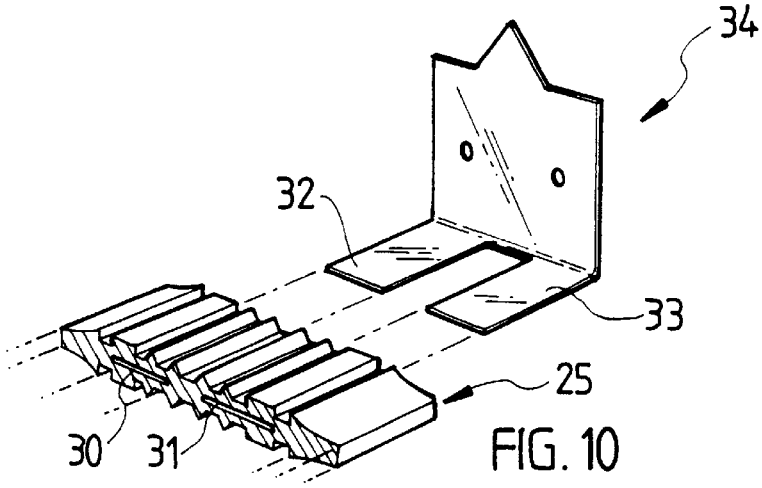

Referring to FIGS. 8 to 10 there is illustrated a separation strip 25 having tapered marginal edges 26 and 27 and shoulders 28 and 29 so that the separation strip can automatically locate in channels of commonly available glass bricks. The separation strip 25 is hollow in that it includes two chambers 30 and 31 adapted to take fingers 32 and 33 of bracket 34 so that the separation strip 25 can be suitably aligned in relation to a frame 35 and glass bricks 36.

A pointer 37 is employed on bracket 34 so the bracket can be centrally located relative to the support 35.

Figure 11:
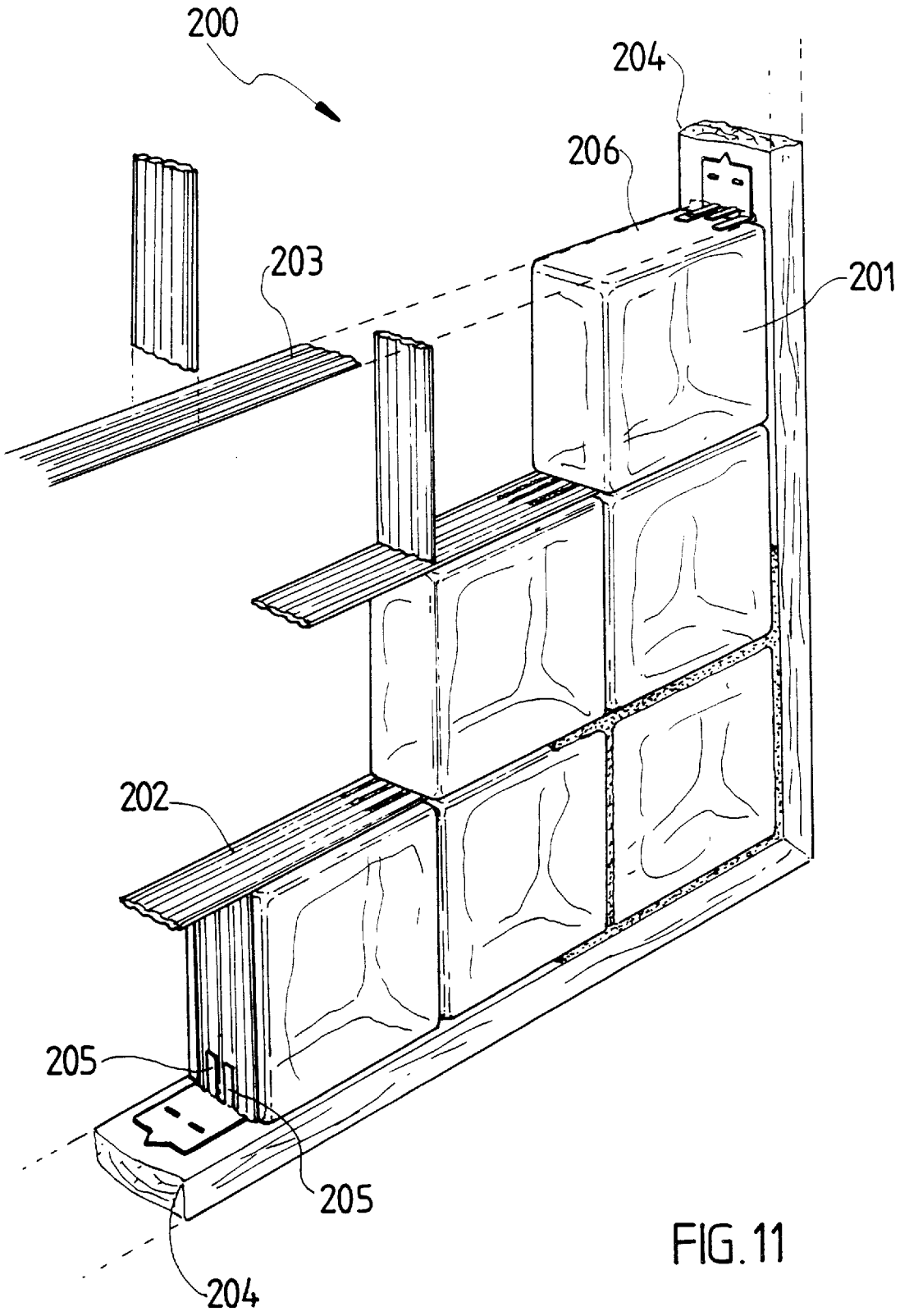
FIGS. 11 and 12 illustrate a still further embodiment of the present invention.

Referring to FIG. 11, there is illustrated a glass brick wall 200 comprising a plurality of glass bricks 201, the glass bricks 201 being supported by separation strips 202 carrying beading 203 and being held in place by brackets 204, the brackets 204 having projecting fingers 205 which are adapted to extend into channels 206 of the glass bricks 201 so the fingers 205 are disposed between the separation strips and the glass bricks.

Figure 12:
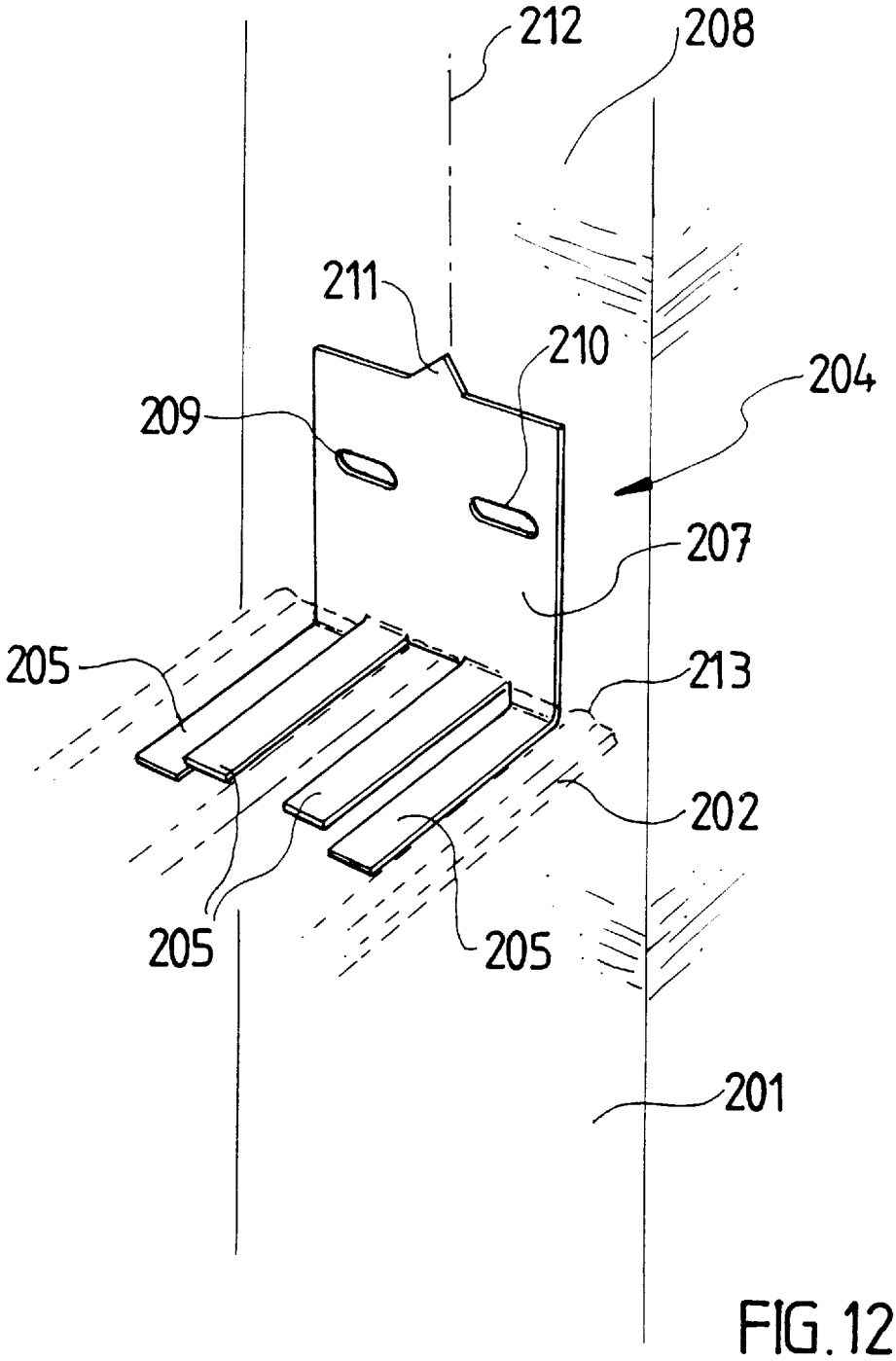

This can be see in more detail in FIG. 12 where like numerals have been used to illustrate like features.

As can be seen the bracket 204 includes a plate section 207 secured to a timber frame 208 by a pair of screws 209 and 210, the bracket 204 being located in place by aligning the pointer portion 210 with a locating line 212 drawn on the timber frame 208. This enables the bracket 204 to be located in the proper position so that the separation strip 202 (shown in phantom) is automatically positioned correctly due to the position of the projecting fingers 205. As can be seen, the fingers 205 have been positioned to straddle the end 213 on the separation strip 202.

In the case illustrated the fingers 205 are just thick enough so that they do not extend above the beading on the separation strip 202 so that they fit flush and are positioned between the separation strip and the adjacent glass bricks without interfering with the positioning of the glass bricks in the glass brick wall.

The brackets 204 are typically made from sheet metal stamped into the general shape illustrated in FIG. 12.

Whilst the above has been given by way of illustrative example of the present invention, many variations and modifications thereto will be apparent to those skilled in the art without departing from the broad ambit and scope of the invention as herein set forth.

We claim:

1. A glass block fire wall comprising vertically extending horizontal runs of glass blocks, each glass block having a peripheral side wall extending between spaced vertical faces, the peripheral side wall of each glass block comprising a channel having a contoured surface, abutting channels of the glass blocks being able to form a void with the contoured surfaces thereof opposed to one another, a horizontally extending separation strip sandwiched between each run of glass blocks, each separation strip comprising a narrow member marginally narrower than the side walls of the glass blocks and being positioned generally centrally between the side walls of adjacent glass blocks, each separation strip being formed from a fibrous cement fire resistant material to inhibit the passage of fire through the wall, each separation strip having opposed contoured continuous peripheral surfaces and opposed edges, the contoured continuous peripheral surfaces of the separation strips being substantially matched to the contoured surfaces of the channels of the glass blocks, the separation strips substantially filling the voids formed by the channels of the glass blocks.

2. A glass block fire wall according to claim 1 wherein each separation strip comprises a thin strip having opposed relatively narrow marginal edge portions and opposed sides bridging between the marginal edge portions, the strip having a longitudinally extending central wasted portion between longitudinally extending bulged portions, the bulged portions being intermediate the marginal edges and the wasted portion.

3. A glass block fire wall according to claim 1 wherein each separation strip comprises a thin strip having opposed relatively narrow marginal edge portions and opposed sides bridging between the marginal edge portions, the strip having a longitudinally extending central wasted portion between longitudinally extending bulged portions intermediate the marginal edges and the wasted portion, the peripheral side wall of each glass block having a channel comprising upstanding peripheral edges and a bottom wall tapering from the edges toward its center so the channel gets gradually deeper toward its center, each bulged portion of each strip being tapered to generally match the taper of the bottom wall of the channel so the separation strip locates in the channel.

4. A glass block fire wall according to claim 1 wherein each separation strip has a profile which is generally bulged with relatively narrow marginal edge portions.

5. A glass block fire wall according to claim 1 wherein each separation strip has opposed ends and respective brackets connecting the ends of the separation strips to vertical supports, the brackets being adapted to enable axial displacement of the separation strips during assembly of the wall, the brackets, separation strips and supports providing a structural framework supporting the wall.

6. A glass block fire wall according to claim 5 wherein each bracket includes a projecting finger and each separation strip is hollow, the projecting finger of the bracket being telescopically fitted into the hollow separation strip.

7. A glass block fire wall according to claim 5 wherein each bracket includes a socket and the separation strip is telescopically slidable in the socket of the bracket.

8. A glass block fire wall according to claim 5 wherein each bracket is L-shaped and includes a position indicating means so the bracket can be located at a predetermined position so that the separation strip supported by the bracket is positioned substantially at an angle of ninety degrees to the vertical supports.

* * * * *